United States Patent [19]

Meckler

[11] 4,033,740

[45] July 5, 1977

[54] COMBINED ENVIRONMENTAL CONTROL AND FIRE PROTECTION SYSTEM

[75] Inventor: Gershon Meckler, Bethesda, Md.

[73] Assignee: Gershon Meckler Associates, Washington, D.C.

[22] Filed: Feb. 23, 1976

[21] Appl. No.: 660,623

[52] U.S. Cl. ..... 62/259; 62/331; 169/19

[51] Int. Cl.² ..... F25D 23/12; F25D 15/00; F25D 23/12; A62C 37/06

[58] Field of Search ..... 62/331, 259; 169/10, 169/16, 19, 23; 165/50, 138

[56] References Cited

UNITED STATES PATENTS

| | | | |
|---|---|---|---|
| 2,721,449 | 10/1955 | Dennick | 62/331 |
| 2,796,740 | 6/1957 | McFarlan | 62/259 |
| 3,169,382 | 2/1965 | Brown | 62/259 |
| 3,490,517 | 1/1970 | Meckler | 62/259 |
| 3,939,914 | 2/1976 | Carroll | 169/16 |

*Primary Examiner*—Lloyd L. King

*Attorney, Agent, or Firm*—Oliver E. Todd, Jr.

[57] ABSTRACT

An improved combined environmental control and fire protection system for a building is disclosed. Water is circulated from cooling apparatus including a closed circuit cooling tower and, when necessary, refrigeration apparatus through supply lines to air handling indirect heat exchangers, lighting fixtures and other heat sources for absorbing heat. The water then circulates through return lines to the cooling apparatus. Automatic sprinkler heads are connected to at least the return lines for fire protection. A pressure sensor detects any drop in water pressure in the circulating system caused by the opening of one or more sprinkler heads and switches the system to a fire protection mode. The pressure sensor opens a valve to connect a pressurized water supply tank to the sprinkler heads. Check valves and motorized valves controlled by the pressure sensor protect the heat exchangers, lighting fixtures and other heat sources from high pressures when the system is operating in a fire protection mode.

5 Claims, 2 Drawing Figures

COMBINED ENVIRONMENTAL CONTROL AND FIRE PROTECTION SYSTEM

BACKGROUND OF THE INVENTION

This invention relates to building construction and, more particularly, to an improved combined environmental control system and fire protection system for a building in which sprinkler heads are mounted on at least the coolant return lines for an environmental control system.

The use of a heat transfer fluid, usually water, has many advantages in environmental control systems for buildings. For example, such a fluid can be circulated into heat transfer relationship with, and to absorb heat from, indirect heat exchangers through which building air is circulated, lighting fixtures, thermal louvers positioned adjacent windows to intercept radiant solar energy, or interceptors for radiation from other energy sources within a building. It frequently is necessary to remove heat from one portion of a building and, at the same time, to add heat to a different portion of the same building. For example, in cooler climates it frequently is necessary to cool interior spaces within a building and, at the same time, to heat exterior spaces in the building. The heat absorbed by heat transfer fluid circulated through one portion of a building can often be used to add the required heat to a different portion of the same building. Ultimately, the circulated heat transfer fluid is returned to an equipment room, and heat is either transferred to the fluid or from the fluid, as required, to maintain a control temperature. Because of the comparatively high temperature level at which heat from lights, from solar energy and from radiant energy sources within a building can be absorbed and transferred to a heat transfer fluid, a cooling tower can be used to transfer heat from the circulated fluid to atmosphere, under cooling conditions. In this way, the energy requirements for air conditioning of a building can be minimized.

In view of an increasing concern for public safety coupled with increasingly stringent building codes, much attention has been given to the necessity for fire protection in buildings. One approach has been to use materials of construction which are resistant to fire for a limited period of time, presumably for a time sufficiently long to enable occupants of the building to escape to the outside. In my U.S. Pat. No. 3,918,525 which issued on Nov. 11, 1975, it is suggested that sprinkler heads may be connected in a water circulating system which is normally used for transferring heat from energy absorbing units within a building, such as lighting fixtures. The absorbed heat is subsequently removed from the fluid in an indirect or closed circuit evaporative cooler. However, the fluid is not cooled below the dew point, to avoid condensation on the circulating system pipes. The sprinkler heads are attached to separate lines which receive water from the circulating system. When a sprinkler head is open, an alarm is generated in response to a flow of water from the system.

SUMMARY OF THE INVENTION

The present invention is based upon the discovery of an improved combination of a low pressure environmental control circulating system and a high pressure fire protection sprinkler system for use in a building. Cooled water is circulated under low pressures from supply lines through motorized throttle valves to indirect heat exchangers, lighting fixtures, thermal louvers, the condensers of air conditioning units, and the like, to absorb heat. The heated water then passes through check valves to return lines which connect to heat removal apparatus such as a closed circuit cooling tower or the evaporator of refrigeration machinery or a combination thereof. The circulating system is operated at temperatures such that the water in the return lines is always above the dew point, thereby eliminating the need for insulating the return lines. A plurality of automatic sprinkler heads are connected to at least the return lines for fire protection. In the event that a sprinkler head is activated, a decrease in pressure or a change in water flow in the return line is sensed by a sprinkler supervisory system. The motorized throttle valves are then closed and a valve is opened to apply water under high pressure to the return line. The pressurized water flows in a reverse direction in the return line to all activated sprinkler heads. The check valves and the closed throttle valves protect the heat exchangers, lighting fixtures, thermal louvers and other low pressure components in the circulating system from the higher pressures required for the sprinkler system.

Accordingly, it is an object of the invention to provide an improved combined environmental control circulating system and fire protection sprinkler system for a building.

Another object of the invention is to provide a combined environmental control circulating system and fire protection sprinkler system in which low pressure apparatus in the environmental control circulating system and high pressure sprinkler heads in a fire protection sprinkler system are connected to the same water lines.

Other objects and advantages of the invention will become apparent from the following detailed description, with reference being made to the accompanying drawings.

DESCRIPTION OF THE PREFERRED EMBODIMENTS

Figure 1:
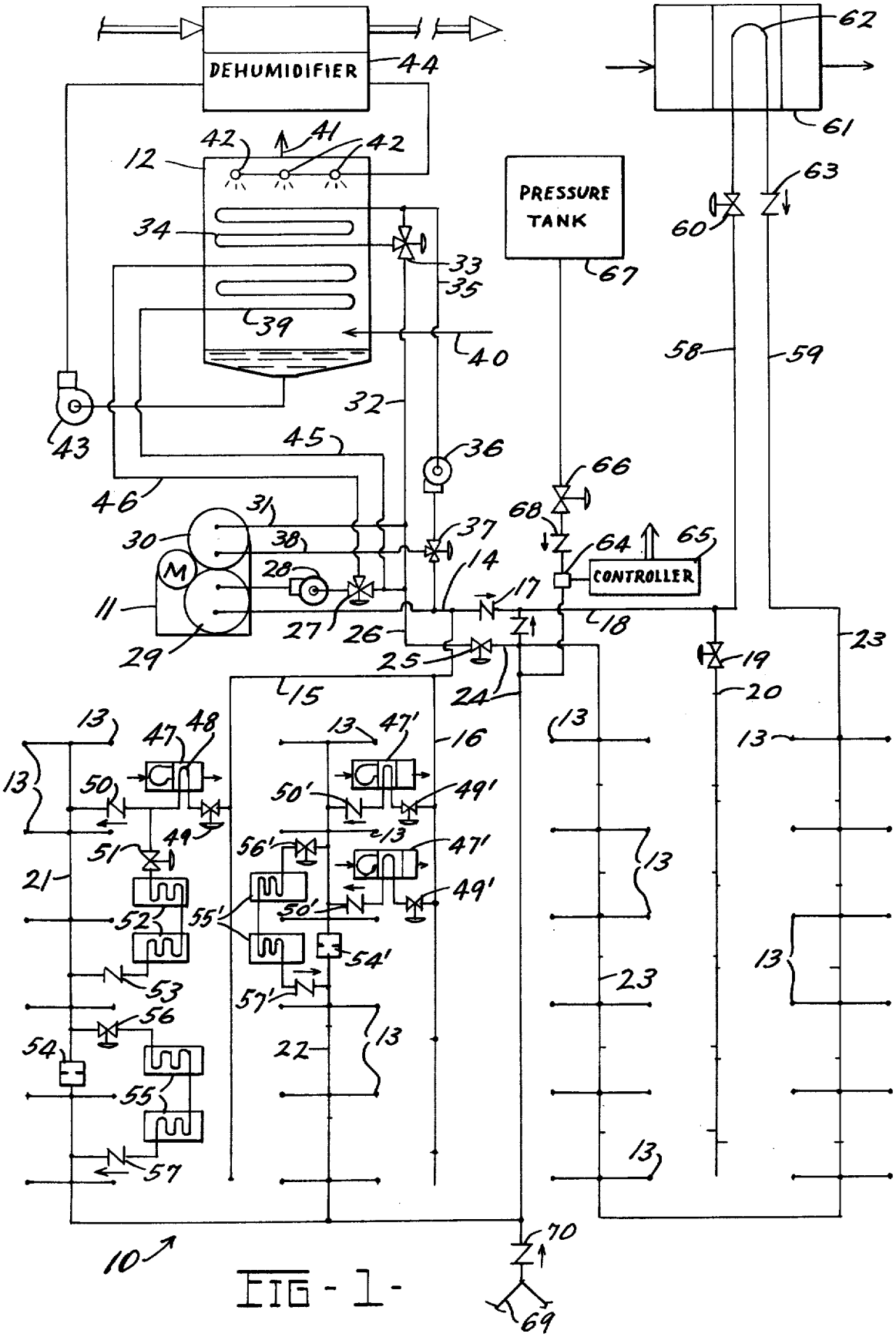
FIG. 1 is a fragmentary schematic block diagram of a combined environmental control and fire protection system constructed in accordance with a first embodiment of the invention.

A first embodiment of a combined environmental control circulating system and fire protection system 10 is shown in FIG. 1. The system 10 is designed for use in environments which require, during at least part of the season, refrigeration machinery 11 in addition to a closed circuit cooling tower 12 for providing sufficient cooling capacity. The system 10 normally functions as a low pressure circulating system for controlling the temperatures within a plurality of inhabited spaces in a bulding. After heat is transferred to the circulated water or other fluid, the water passes through return lines back to either the refrigeration machinery or the cooling tower, or a combination thereof, where it is again cooled. The system is operated such that the water in the return lines is never below the dew point. A plurality of fire protection sprinkler heads 13 are connected in the return line for providing fire protection to the building. In the event of a fire opening one of the sprinkler heads 13, the system 10 is automatically switched to a fire protection mode by a sprinkler supervisory system and high pressure water is pumped in a reverse direction through the return lines to the activated sprinkler heads 13. A series of automatic valves and check valves are connected to protect the low pressure components of the circulating system while the system 10 is operated in the fire protection mode, as is discussed in detail below.

During normal operation of the system 12 in the environmental control circulating mode, the refrigeration machinery 11 and/or the cooling tower 12 are connected to supply cooled water to a main supply line 14. Preferably, the temperature of the water in the main supply line 14 is about 55° F., which normally is above the dew point within the building containing the system 10. However, the main supply line 14 and all connected supply lines carrying the cooled water preferably are insulated. The line 14 is connected to distributor supply lines 15 and 16 and also is connected through a check valve 17, a line 18 and a normally open automatic valve 19 to a distributor supply line 20. The supply lines 15, 16 and 20 are merely exemplary of a number of distributor supply lines in a building. The supply lines 15 and 16, for example, may supply cooled or chilled water to different areas on one floor of a building while the supply line 20 supplies water to a different floor in the building. The cooled water in the supply line 15 flows through one or more heat sinks, such as indirect heat exchangers and lighting fixtures, to a return line 21, chilled water from the supply line 16 flows through heat sinks to a return line 22 and chilled water from the supply line 20 flows through heat sinks to a return line 23. The return lines 21, 22 and 23 are in turn connected together through a main return line 24 and a normally open motorized valve 25 to a return line 26 which connects to the refrigeration machinery 11 and the cooling tower 12.

The actual manner in which the water in the return line 26 is chilled depends upon the outside conditions. In a typical system 10, the water in the return line 26 will be on the order of 75° F. At this temperature, the return lines 21–24 and 26 and all sprinkler heads 13 will be considerably above the dew point. This eliminates the need for insulating the water return system, as in prior art circulating water air cooling systems. The refrigeration machinery 11 and the cooling tower 12 are operated to cool this water to approximately 55° F. and to apply the cooled water to the main line 14. Under design conditions, assumed to be 91° F. dry bulb and 78° F. wet bulb, water in the return line 26 passes through a diverting valve 27 and a pump 28 to an evaporator 29 in the refrigeration machinery 11 where it is chilled. From the evaporator 29, the chilled water flows directly to the main supply line 14. The refrigeration machinery 11 is a heat pump which transfers heat from fluid circulated through the evaporator 29 to fluid circulated through a condenser 30. Water circulated through the condenser 30 is heated and passes therefrom to a line 31. The line 31 is connected through a line 32 and a motorized mixing valve 33 to a coil 34 in the cooling tower 12. From the coil 34, the cooled fluid or water is circulated through a line 35, a pump 36, a diverting valve 37 and a line 38 back to the condenser 30. The mixing valve 33 may be adjusted to permit a predetermined portion of the water in line 32 to bypass the coil 34 for controlling the temperature of the water in the line 35.

The cooling tower 12 is shown as including the coil 34 and a coil 39 for indirect head transfer from water or other heat transfer fluid circulated therein. Outside air is taken in at the bottom of the cooling tower 12, as represented by the arrow 40, flows upwardly past the coils 39 and 34 and is discharged at the top of the cooling tower 12, as represented by the arrow 41. At the same time, water is sprayed downwardly from a plurality of nozzles 42 located adjacent the top of the cooling tower 12. As the sprayed water particles evaporate, heat is removed from the cooling tower 12 and from the fluid circulated through the coils 34 and 39. A pump 43 circulates water collected at the bottom of the cooling tower 12 through a dehumidifier 44 and back to the nozzles 42. The dehumidifier 44, which is optional, may be used for dehumidifying fresh outside air delivered to the building being air conditioned by the system 10. The water may be circulated by the pump 43 through the dehumidifier 44 where heat is removed from a dessicant such as a glycol solution after such dessicant is regenerated.

Under the assumed design conditions of an outside temperature of 91° F. dry bulb and 78° F. wet bulb, the water circulated by the pump 43 through the dehumidifier 44 and sprayed into the cooling tower 12 has a temperature of 96.5° F. when it is sprayed from the nozzles 42 and a lower temperature of 85° F. when it is collected at the bottom of the cooling tower 12. At the same time, water circulated by the pump 36 through the condenser 30 in the refrigeration machinery 11 is cooled from 95° F. in the line 32 to 85° F. when it leaves the coil 34 and flows through the line 35. Under these conditions, the refrigeration machinery 11 is used to chill water circulated through the evaporator 29 to 55° F. for cooling the building in which the system 10 is located.

As the outside temperature decreases from the above assumed design conditions, the load on the refrigeration machinery 11 is decreased. The diverting valve 27 is then automatically positioned to divert at least a portion of the water in the return line 26 through a line 45, the coil 39 in the cooling tower 12 and a line 46. As a consequence, the temperature of the water flowing to the evaporator 29 is decreased to decrease the load on the refrigeration machinery 11 while maintaining the chilled water flowing from the evaporator 29 at 55° F. As the outside wet bulb temperature further drops, an increased load is assumed by the cooling tower coil 39. When the outside wet bulb temperature drops to about 48° F., the refrigeration machinery 11 is operating in the neighborhood of 10 percent of its maximum load capacity. At this point, the refrigeration machinery 11 and the pump 28 are shut off and the diverting valve 37 is repositioned. The pump 36 then circulates water through the diverting valve 37 to the main supply line 14 for circulation through heat sources located within the building. The heated water in the main return line 26 then flows through the line 32, the valve 33 and the cooling tower coil 34 where such water is cooled to 55° F. The valve 33 may be positioned to allow some of the water to bypass the coil 34 for maintaining a constant 55° F. temperature.

It should be noted here that at times the outside air will be sufficiently cool as to permit circulating such cool outside air directly to building spaces to provide the cooling requirements in the building. However, it is more efficient to use the cool outside air for cooling water in a circulating system and then circulating the cooled water to such building spaces and through heat exchangers for cooling the spaces. This is due to the fact that pumping water through the circulating system to a space to be cooled requires considerably less energy than operating a blower for circulating cool outside air through air ducts to cool the spaces to the same temperature.

As indicated above, chilled water flows from the main supply line 14 to the distributor supply lines 15, 16 and 20 and thence through heat sources such as indirect heat exchangers for cooling air circulated to building spaces being cooled, to water cooled lighting fixtures, to thermal louvers, and the like. An exemplary indirect heat exchanger 47 is shown having a water cooled coil 48 connected in series between the chilled water supply line 15 and the return line 21. The indirect heat exchanger 47 may also be a heat pump such as a conventional electric air conditioner. The coil 48 is connected to absorb heat from the condenser. This allows cooling a space below the temperature of the water in the supply lines 14–18 and 20. A motorized throttle valve 49 is positioned between the coil 48 and the chilled water line 15 and a check valve 50 is positioned between the coil 48 and the return line 21. The valve 49 is automatically positioned to maintain a predetermined temperature in air discharged from the heat exchanger 47. The cooled air from the heat exchanger 47 may be supplied directly to a conditioned air space within the building or, it may pass through a mixing box (not shown) where it is mixed with dehumidified outside air prior to delivery to the conditioned space. The water flowing from the coil 48 in the heat exchanger 47 is shown also as being connected through a motorized throttle valve 51 to two series connected water cooled lighting fixtures 52. The relatively cool water flows through passageways within the fixtures 52 for removing heat generated by the light sources. From the fixtures 52, the warm water passes through a check valve 53 to the return line 21. When the throttle valve 51 is closed, water discharged from the heat exchanger 47 flows through the check valve 50 to the return line 21, while a portion of such discharged water flows through the lighting fixtures 52 and the check valve 53 to the return line 21 when the throttle valve 51 is opened.

A restrictive orifice 54 is shown positioned within the return line 21. Two water cooled lighting fixtures 55 are connected in series across the orifice 54. When a motorized throttle valve 56 is opened, some of the water flowing through the return line 21 passes through the valve 56, the two lighting fixtures 55 and a check valve 57 back to the return line 21 and the remaining water flows directly through the orifice 54. It should be noted that the orifice 54 should be sufficiently small as to cause some water to flow through the lighting fixtures 55 when the valve 56 is opened but should not be so small as to restrict water flow to the sprinkler heads 13 attached to the return line 21 in the event of a fire. It should be appreciated that the heat exchanger 47 and the lighting fixtures 52 and 55 are merely exemplary of different connections between the chilled water supply line 15 and the return line 21. A plurality of similar heat exchangers, lighting fixtures and similar fixtures are connected between the chilled water line 15 and the return line 21 for supplying the environmental control requirements in the portion of the building serviced by these lines. Similar connections are made between the chilled water supply line 16 and the return line 22 and between the chilled water supply line 20 and the return line 23. However, for the sake of simplicity, only a few exemplary fixture connections have been shown in FIG. 1. Other exemplary heat exchangers shown in FIG. 1 are designated with the reference number 47', with the connected valves designated by the references 49' and 50' and other exemplary lighting fixtures have been designated with the reference numbers 55', with the associated throttle and check valves designated by the references 56' and 57', respectively.

In addition to the above-described heat exchangers, the supply line 18 is connected to a line 58 and the return line 23 is connected to a line 59. The lines 58 and 59 serve dual purposes as a riser for the heating-ventilating-air conditioning system and as a standpipe for the system when operated in a fire protection mode. The line 58 is connected through one or more normally open motorized valves 60 to one or more heat exchangers, such as the air cooling indirect heat exchanger 61. From a coil 62 within the heat exchanger 61, the water flows through a check valve 63 to the line 59 and is subsequently returned through the lines 23, 24 and the valve 25 to either the refrigeration machinery 11 and/or the cooling tower 12 for chilling. The above described use of the pipes 58 and 59 both as a riser for the circulating system and a standpipe for the fire protection system has not been used in prior art systems combining both circulating systems and fire protection systems.

Under normal conditions within the building in which the system 10 is installed, the system 10 will operate as described above. In the event that a fire should occur within the building, the system 10 will switch over to a fire protection mode of operation as soon as any one of the automatic sprinkler heads 13 is triggered. The sprinkler heads 13 are of a conventional design and typically include a fusable element which melts when subjected to a predetermined high temperature. As soon as the fusable element melts and water begins to flow from a sprinkler head 13, water pressure within the circulating system 10 starts to drop. This drop in pressure is detected by a sprinkler supervisory system such as a pressure sensor 64 located at any suitable point in the return lines for the circulating system 10. The pressure sensor 64 is connected to a suitable controller 65 which drives or energizes all of the motorized valves including the valves 49, 51, 56, 19, 25, 60 and a normally closed valve 66 and de-energizes the refrigeration machinery 11 and the pumps 28, 36 and 43. When the controller 65 drives the valve 66 from its normally closed to an open position, a tank 67 filled with water under pressure is connected through the valve 66 and a check valve 68 to the main return line 24. Water from the tank 67 then flows in a reverse direction through the return line 24 and one or more of the return lines 21, 22 and 23 to the opened sprinkler head 13.

It will be noted that the water applied to the main return line 24 from the tank 67 is under pressures considerably higher than the low pressures normally encountered by the circulating system when operating in a heating-ventilating-air conditioning mode. All heat exchange apparatus in the system 10 is protected from the higher pressures by the various motorized valves and check valves. For example, the check valve 17 and the normally opened motorized valve 25, which is closed by the controller 65, protect the refrigeration machinery 11 and the cooling tower 12 from the higher pressures applied to the return line 24 when the system 10 is in the fire protection mode. Similarly, the closed throttle valve 49 and the check valve 50 protect the heat exchanger 47 from the higher pressures, the closed motorized valve 51 and the check valve 53 protect the lighting fixtures 52 and the closed motorized valve 56 and the check valve 57 protect the lighting fixtures 55 from the higher pressures in the main return line 24 and connected return lines 21–23.

The pressurized tank 67 is designed to supply water to the activated sprinkler heads 13 during the short time interval between activation of one or more of such sprinkler heads 13 and the arrival of fire department pumpers. For example, the tank 67 may be provided with sufficient capacity for supplying water to a limited number of activated sprinkler heads 13 for a period of twenty minutes, which should be sufficient time for the fire department to reach the location of the building. When the fire department reaches the building, a pumper is connected from a fire hydrant to one or more connectors 69 mounted at a convenient location outside the building in which the system 10 is installed. The connectors 69 are connected through a normally closed check valve 70 to the main return line 24. When the pumper is then turned on to apply high pressure water to the system 10, the water flows from the connectors 69 through the check valve 70, the main return line 24 and one or more of the distributor return lines 21–23 to the open sprinkler heads. The pumper will then maintain a flow of high pressure water to the system 10 until the fire is extinguished. During the time that the pumper is operated, the check valve 68 prevents water from flowing from the main return line 24 into the pressurized tank 67.

From the above description, it will be apparent that the system 10 is operable for supplying both the environmental control needs for a building and the fire protection needs for such building. The system provides for the common use of a number of lines including the return lines 21–24 and the line 59 for serving both the circulating and the fire protection needs of the building. Each of the commonly used lines is maintained at temperatures above the dew point to eliminate the need for insulating such lines. When the system 10 is operated in a fire protection mode, all low pressure components required for the circulating system are isolated from the high pressures required for the fire protection system through the use of motorized valves and check valves.

Figure 2:
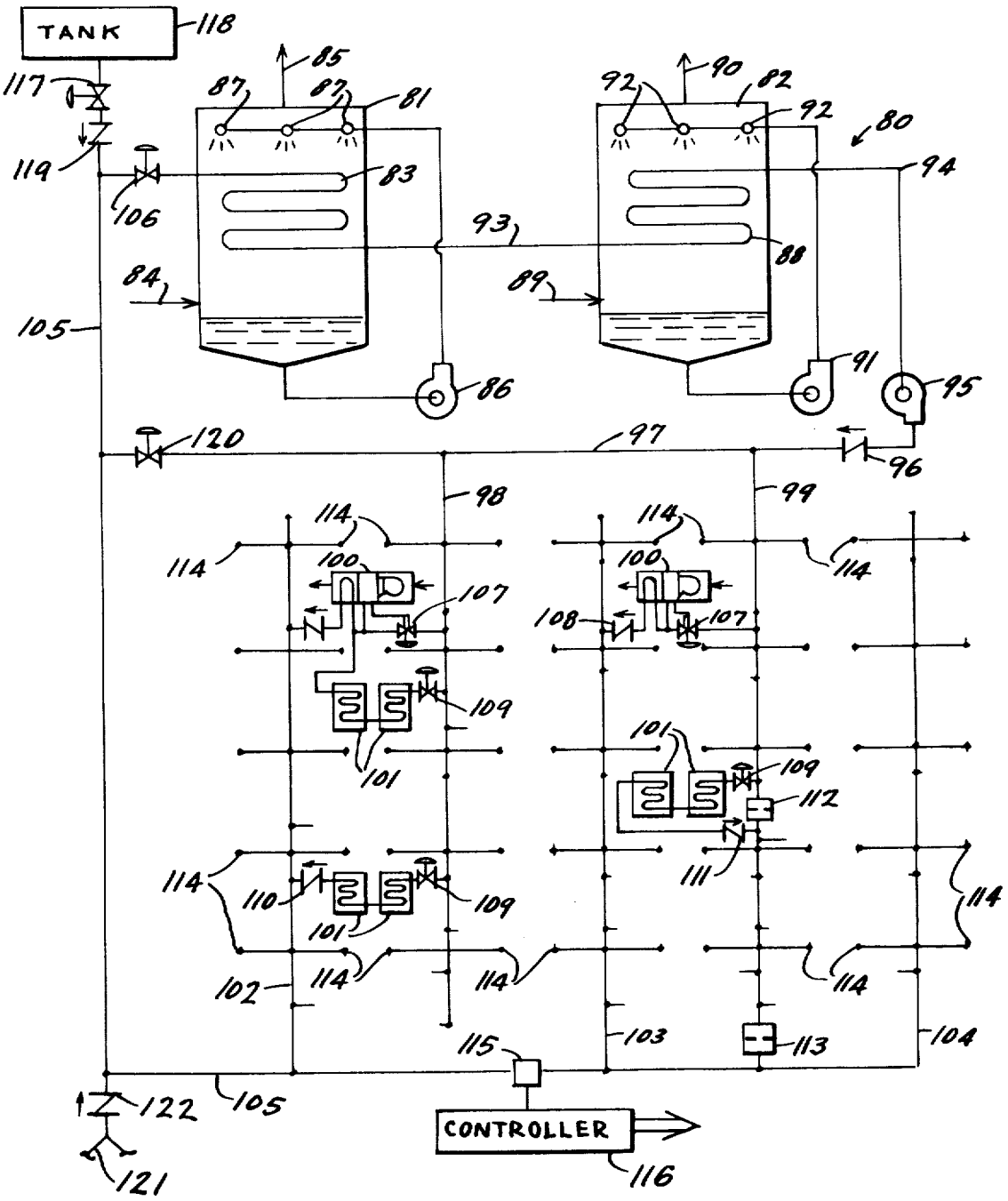
FIG. 2 is a fragmentary schematic block diagram of a combined environmental control and fire protection system constructed in accordance with a second embodiment of the invention.

Referring now to FIG. 2, a modified embodiment is shown of a system 80 combining a heating-ventilating-air conditioning circulation system and a fire protection system for a building. The system 80 is designed for operation in a climate wherein sufficient water cooling capacity is provided by means of a cooling tower 81 through which outside air is circulated and/or a second cooling tower 82 through which low humidity exhaust air from the building in which the system 80 is installed is directed. The cooling tower 81 includes a coil 83 through which water or a similar heat transfer fluid is circulated for chilling. Outside air enters the cooling tower 81 through an air inlet 84 adjacent the bottom of the tower 81 and leaves through an outlet 85 adjacent the top of the tower 81. At the same time, a pump 86 circulates water from a collection reservoir at the bottom of the cooling tower 81 to a plurality of nozzles 87 located adjacent the top of the cooling tower 81. As the water is sprayed downwardly into the cooling tower 81 and outside air is circulated upwardly through the tower 81, water evaporation cools the water circulated through the coil 83. Similarly, the cooling tower 82 includes a coil 88 through which water to be cooled is circulated, an air inlet 89 through which building exhaust air flows, an air outlet 90 which is exhausted to the atmosphere and a pump 91 which circulates water from the bottom of the cooling tower 82 to a plurality of nozzles 92 located adjacent the top of the cooling tower 82. Water flows from the coil 83 in the cooling tower 81 through a line 93 to the coil 88 in the cooling tower 82 and thence through a line 94, a circulating pump 95 and a check valve 96 to a main cool water supply line 97.

The main supply line 97 for the cooled water is connected to a plurality of distributor supply lines, two of which lines 98 and 99 are shown. A plurality of heat sources such as refrigeration units 100 and water cooled lighting fixtures 101 are connected in parallel between the distributor supply lines 98 and 99 and a plurality of return lines, of which three lines 102–104 are shown. The return lines 102–104 are in turn connected to a main return line 105. The main return line 105 is connected through a normally open motorized valve 106 to the coil 83 within the cooling tower 81 to complete the circulation circuit. The refrigeration units 100 are connected with a motorized mixing valve 107 between the distributor supply line and the inlet to the refrigeration unit and a check valve 108 between the outlet of such refrigeration unit and the return line. The lighting fixtures 101 have a throttle valve 109 connected between a fluid inlet and the associated distributor supply line 98 or 99 and have a fluid outlet which may be connected through either the check valve 108 or a check valve 110 to an associated one of the return lines 102–104. The lighting fixtures 101 may also have an outlet connected through a check valve 111 back to the distributor supply line 98 or 99. In such event, a restrictive orifice 112 is located in such distributor supply line between the inlet to and outlet from the lighting fixtures 101. In the event that such a restrictive orifice 112 is positioned within one or more of the distributor supply lines, supply line 99 shown, a second restrictive orifice 113 is connected between such distributor supply line 99 and the main return line 105 to maintain a fluid flow through the supply line 99 and the connected lighting fixture 101. The restrictive orifice 112 is of such a diameter as to maintain a flow of cooling water through the lighting fixture 101 when the throttle control valve 109 is open. However, the restrictive orifice 112 should not be so small as to appreciably reduce fluid flow to water cooled heat sources located downstream therefrom.

The cooling towers 81 and 82 are operated to maintain the water in the main supply line 97 at or below 70° F., but above the dew point within the building in which the system 10 is installed. Under peak outside temperature and humidity conditions, the cooling tower 81 is unable to cool the supply water to 70° F. and, for example, may cool the supply water to only about 80° F. The second cooling tower 82 is operated to provide the additional cooling. The building exhaust air will have a considerably lower wet bulb temperature that the outside air under peak design conditions. This permits cooling the return water to or below 70° F. However, there is insufficient building exhaust air to cool the return water to 70° F. in the cooling tower 82 alone, since the return water may be as hot as 90° F. or more. The actual temperature of the return water will depend upon the type and number of fixtures connected between the supply and return lines.

In the above description, the system 80 is functioning in a heating-ventilating-air conditioning mode for circulating a coolant such as water to a plurality of heat sources such as the refrigeration units 100, water cooled lighting fixtures 101, thermal louvers (not shown) and the like. The system 80 also includes a plurality of automatic sprinkler heads 114 connected both to the distributor supply lines 98 and 99 and to the return lines 102–104. The sprinkler heads 114 may be connected to these lines without causing condensation problems since all of these lines are maintained above the dew point at all times. In the event that a fire or other high temperature condition activates one or more of the automatic sprinkler heads 114, as by melting a fusable element, water will flow from the system 80 through such activated sprinkler head 114 and onto the fire or other source of high temperature. This causes a drop in the water pressure within the system 80 which is sensed by a sprinkler supervisory system such as a conventional pressure sensor 115. When the pressure sensor 115 senses a pressure drop, an associated controller 116 switches the system 80 to a fire protection mode by deactivating the pumps 86, 91 and 95 and activating all automatic valves. A motorized valve 117 is activated to connect a tank 118 containing a volume of water under pressure through a check valve 119 to the main return line 105. The normally open motorized valve 106 is closed to protect the cooling tower coils 83 and 88 and the pump 95 from the high pressure water applied to the main return line 105. In addition, a normally closed motorized valve 120 is opened by the controller 116 to apply the pressurized water to the main supply line 97 and thence to the distributor supply lines 98 and 99. At this time, the check valve 96 is closed to completely isolate the pump 95 and the cooling tower coils 83 and 88 from the high pressure water. Similarly, the controller 116 closes all motorized throttle valves 107 and 109. The closed valves 107 and 109 and the check valves 108, 110 and 111 protect each of the heat sources such as the refrigeration units 100 and the lighting fixtures 101 from the high pressure water in the return lines 102–105 and the supply lines 97–99. The tank 118 is designed to hold a sufficient supply of water under pressure to operate the system 80 in a fire protection mode for a limited period of time, such as 20 minutes. During this time period, a fire pumper is connected from a fire hydrant and through a connector 121 and a check valve 122 to the main return line 105 for continuing the delivery of high pressure water to the sprinkler heads. The high pressure water supplied by such pumper, for example, may be on the order of 300 psi pressure. During this time, all components of the heating-ventilating-air conditioning portion of the system 80 with the exception of the main supply line 97 and the distributor supply lines 98 and 99, the main return line 105 and the connected return lines 102–104 are isolated from the high pressure.

The two above-described embodiments of combined environmental control circulating systems and fire protection systems are merely exemplary of the invention. It will be appreciated that various modifications may be made in the described systems and particularly in the components required for cooling or chilling heat transfer fluid circulated through the system when operated in a heating-ventilating and air conditioning mode. Furthermore, the types and connections of the various heat sources which require cooling are merely exemplary. The heat sources are generically referred to as "energy absorbing units" in the following claims and include, for example, refrigeration machinery and other heat pumps, indirect heat exchangers, water cooled lighting fixtures and thermal louvers. The systems 10 and 80 have been described as normally operating in an air conditioning or cooling mode. It should be appreciated that the water circulated to the exterior zones in buildings located in cooler climates may require heating. Or, water heated as it flows through heat sources located in interior building zones may be used for supplying heat to exterior building zones in accordance with prior art heating-ventilating-air conditioning systems. The specific manner in which heat is transferred to or from the circulating heat transfer fluid may be varied without departing from the spirit and the scope of the following claims.

What I claim is:

1. An improved circulating system for a building comprising a plurality of energy absorbing units located within the building, cooling means for cooling a heat transfer fluid, supply line means for circulating cooled heat transfer fluid from said cooling means to said energy absorbing units, return line means for circulating such heat transfer fluid from the energy absorbing units to said cooling means, open valve means located between said return line means and said cooling means, a plurality of check valves, means mounting said check valves between said energy absorbing units and said return line means, said check valves being oriented to prevent a fluid flow from said return line means to said energy absorbing units while being ineffective to prevent a fluid flow in a reverse direction, a plurality of sprinkler heads each including means responsive to a predetermined high temperature for activating such sprinkler heads, means connecting said sprinkler heads to said return line means, means for sensing a flow of heat transfer fluid from any of said sprinkler heads, means responsive to said sensing means sensing a fluid flow from any sprinkler head for closing said open valve means, means responsive to said sensing means sensing a fluid flow from any sprinkler head for supplying water under pressure to said return line means, and wherein said cooling means includes first and second closed circuit evaporative cooling means for transferring heat from the circulated heat transfer fluid to air circulated through said evaporative cooling means, means for circulating the heat transfer fluid sequentially from said return line means through said open valve means and said first and second evaporative cooling means to said supply line means, means for circulating fresh outside air through said first evaporative cooling means and means for exhausting air from the building through said second evaporative cooling means to the atmosphere, whereby the circulated heat transfer fluid is cooled to a temperature above the dew point of air in the building.

2. An improved circulating system for a building, as set forth in claim 1, and further including a plurality of throttle valve means located between said supply line means and said energy absorbing units for controlling the flow of heat transfer fluid to each energy absorbing unit, and wherein said means responsive to said sensing means sensing a fluid flow from any sprinkler head for closing said open valve means includes means for simultaneously closing all of said throttle valve means.

3. An improved circulating system for a building, as set forth in claim 2, wherein said cooling means includes closed circuit evaporative cooling means for transferring heat from the circulated heat transfer fluid to the atmosphere, refrigeration means for pumping heat from the circulated heat transfer fluid to the atmosphere, and means for selectively controlling the flow of circulated heat transfer fluid to said evaporative cooling means and said refrigeration means whereby the circulated heat transfer fluid is cooled to a temperature above the dew point of the air within the building.

4. An improved circulating system for a building, as set forth in claim 2, and further including a second plurality of sprinkler heads each including means responsive to a predetermined high temperature for activating such second sprinkler heads, means connecting said second sprinkler heads to said supply line, a check valve mounted between said cooling means and said supply line means and oriented for preventing a fluid flow from said supply line means to said cooling means while being ineffective for preventing a fluid flow in a reverse direction, and valve means located between said supply line means and said return line means for normally preventing fluid flow from said supply line means to said return line means and for permitting fluid flow from said return line means to said supply line means when any of said second sprinkler heads is activated, and wherein said sensing means senses a flow of heat transfer fluid from any of said pluralities of sprinkler heads.

5. An improved circulating system for a building, as set forth in claim 1, wherein said plurality of energy absorbing units includes a plurality of refrigeration means each having evaporator means for supplying cool air within the building and a condenser, and wherein the cooled heat transfer fluid is circulated to absorb heat from said condensers.

* * * * *